US005768714A

United States Patent [19]

Bowhey

[11] Patent Number: 5,768,714

[45] Date of Patent: Jun. 23, 1998

[54] TOY AND HELMET COMBINATION

[76] Inventor: Ian Larry David Bowhey, 2233 Hurontario Street, Apt. 1204, Mississauga, Ontario L5A 2E9, Canada

[21] Appl. No.: 812,513

[22] Filed: Mar. 7, 1997

[51] Int. Cl.[6] ..... A42B 1/24; A42B 1/06

[52] U.S. Cl. ..... 2/410; 2/209.13; 446/27

[58] Field of Search ..... 2/410, 422, 425, 2/171, 209.13; 446/27, 26, 71, 85, 86, 88, 93, 227; D2/865, 866, 895, 869, 899, 892

[56] References Cited

U.S. PATENT DOCUMENTS

| | | | |
|---|---|---|---|
| D. 256,482 | 8/1980 | Brown . | |
| D. 276,358 | 11/1984 | Murskami . | |
| D. 339,805 | 9/1993 | Hartman . | |
| D. 347,037 | 5/1994 | Galloway . | |
| 1,551,454 | 8/1925 | Bacon . | |
| 1,727,484 | 9/1929 | Myers . | |
| 2,258,531 | 10/1941 | Baldwin | 446/26 |
| 2,760,304 | 8/1956 | Chirco et al. . | |
| 3,077,051 | 2/1963 | Quinones, Jr. . | |
| 3,596,289 | 8/1971 | Adickes . | |
| 3,616,571 | 11/1971 | Adickes . | |
| 4,589,660 | 5/1986 | Tsuzuki | 446/26 |
| 4,991,235 | 2/1991 | Warner . | |
| 5,328,399 | 7/1994 | Reynolds . | |
| 5,561,864 | 10/1996 | Demars | 446/27 |

*Primary Examiner*—Gloria Hale
*Attorney, Agent, or Firm*—Peter R. Hammond

[57] ABSTRACT

A toy vehicle and helmet combination includes a protective helmet suitable for wearing on a user's head. The helmet, which can be suitable for riding a bicycle, includes a rigid shell with an open bottom, an upper section with one or two slots formed therein, and a lower section extending around the open bottom. Pairs of holes can be formed in the lower section with the holes of each pair located in opposite sides of the lower section and substantially aligned. A toy body section with an upper body member is mounted on top of the shell and has one or two downwardly extending connecting members sized to extend through the slots in the shell. There are also toy wheels and shafts rotatably mounting same to the helmet.

23 Claims, 12 Drawing Sheets

TOY AND HELMET COMBINATION

BACKGROUND OF THE INVENTION

This invention relates to both toys and helmets for wearing on a user's head and, in particular, to a toy and helmet combination.

It is well known to provide helmets to protect a person's head during certain activities. Such helmets which normally include a hard, protective shell, together with some padding inside the shell, include helmets designed for riding bicycles, motor bikes and motorcycles. Protective helmets are also commonly used for the playing of sports such as hockey and football. The design and shape of these protective helmets is often customized to suit the particular activity or sport. Often the use of such helmets is required by law or by the organization or association responsible for supervising the activity.

It can sometimes be difficult for parents who must supervise the activities of young children to have them wear protective clothing or head gear, particularly when the wearing of same can result in some perceived discomfort. It can be particularly difficult to ensure that children wear protective head gear when they are not within viewing range of the parent or adult supervising their activity. The wearing of a protective helmet by children may be encouraged if they like the helmet or its design for some reason or associate it with a pleasurable activity such as play.

It is an object of the present invention to provide a toy and helmet combination wherein a protective helmet suitable for wearing on a user's head can also be used to form a toy such as a vehicle or aircraft when it is not being used as a protective helmet. The toy and helmet combination described herein can take various forms and it can be made at a reasonably low cost so that it is not substantially more expensive than a standard protective helmet without the added toy feature.

It is a further object of the invention to provide a toy and helmet combination which is quite simple in construction and is easy for most children to use and assemble or disassemble.

SUMMARY OF THE INVENTION

According to one aspect of the invention, a toy vehicle and helmet combination comprises a protective helmet suitable for wearing on a user's head, this helmet including a rigid shell with an open bottom, an upper section with at least one opening formed therein and a lower section extending around the open bottom. A toy body section with an upper body member is adapted for mounting on top of the upper section of the shell and for combining with the shell to form a toy vehicle. At least one downwardly extending connecting member is joined to the upper body member and is sized to extend through the at least one opening in order to detachably connect the body section to the shell. Toy wheels and at least one supporting mechanism for mounting the wheels are also provided. The lower section of the helmet includes means for detachably attaching the at least one supporting mechanism to the shell.

Preferably there are at least two openings in the shell and these openings are narrow, elongate, parallel slots extending in the front to back direction of the helmet. Also, the preferred embodiments use two connecting members in the form of relatively rigid plate members having a thickness corresponding closely to the width of each slot.

According to another aspect of the invention, a toy car and helmet combination includes a protective helmet suitable for wearing on a user's head, this helmet including a rigid shell with an open bottom and at least one opening. The shell has a lower section extending around the open bottom. Two toy sections are also provided for forming a toy car with this helmet. Each section is adapted for mounting on top of the rigid shell and has at least one connecting member that is sized and arranged to extend through said at least one opening in order to detachably connect the toy section to the shell. There are also toy wheels and at least one supporting mechanism for mounting same. The lower section of the helmet includes means for detachably attaching the at least one supporting mechanism to the shell.

In this version of the invention, one of the toy sections is preferably a simulated spoiler having an upper surface that curves upwardly and rearwardly from a transversely extending forward edge thereof. This simulated spoiler is mounted near a rear end of the helmet.

According to a further aspect of the invention, a toy flying craft and helmet combination includes a protective helmet suitable for wearing on a user's head, this helmet including a rigid shell with an open bottom, an upper section with at least one opening formed therein, and a lower section extending around the open bottom. A toy flying craft body section with a rearwardly extending tail section is also provided. This body section is mountable on top of the upper section of the shell in order to combine with the shell to form a toy flying craft and has at least one connecting member that is sized and arranged to extend through the at least one opening in order to detachably connect the body section to the shell. This combination further includes toy wheels and at least one supporting mechanism for mounting the toy wheels. The lower section of the helmet includes means for attaching the at least one supporting mechanism to the shell.

In a preferred embodiment, the body section has the shape of an airplane and two elongate substantially horizontal wings extend from opposite sides of the body section.

Further features and advantages will become apparent from the following detailed description taken in conjunction with the accompanying drawings.

DETAILED DESCRIPTION OF PREFERRED EMBODIMENTS

Figure 1:
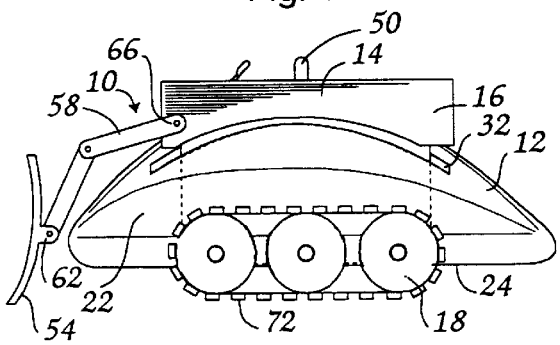
FIG. 1 is a side elevation of a toy vehicle and helmet combination constructed in accordance with the invention.

FIGS. 1 to 3 and 6 illustrate a first embodiment of the invention, which embodiment comprises a toy vehicle and helmet combination 10. When this combination is fully assembled to form a toy vehicle, the toy vehicle simulates a bulldozer commonly used in construction work. The combination 10 includes the basic features of a protective helmet 12 suitable for wearing on a user's head, a toy body section 14 with an upper body member 16 adapted for mounting on top of the helmet and pairs of toy wheels 18 and shafts 20 for rotatably mounting these wheels. The shafts 20 are a preferred form of supporting mechanism for mounting the wheels. Except for the modifications detailed herein, the protective helmet 12 can be the same in its construction to standard, known protective helmets such as those sold for use by bicycle riders or those used in other sporting activities. The helmet includes a hard outer shell commonly made up of hard, suitable plastic and its exterior colouring may be a colouring normally associated with bulldozers, for example, a deep yellow or red. The interior of the shell can be provided with suitable padding (not shown) to make the helmet comfortable to wear and to provide further protection. The hard shell 22 has an open bottom 24, an upper section 26, and a lower section 28 which extends around the open bottom. The upper section 26 is formed with at least one opening and preferably two openings 30 and 32 to provide means for connecting the body section 14. In the illustrated preferred embodiment, the openings 30, 32 are narrow, elongate parallel slots extending in a front to back direction of the helmet. Although only two openings are shown in the illustrated helmet, it is possible to have as few as one opening or three or more openings provided for use in connecting the toy body section. However, the number of openings should not be so great and the size of the openings should not be so large that the structural integrity of the helmet is affected, thereby reducing its protective capability.

Figure 6:
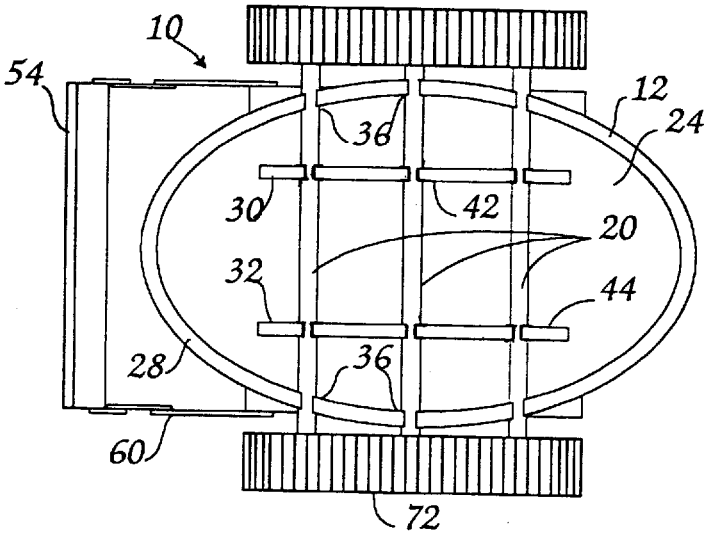
FIG. 6 is a bottom view of the toy vehicle and helmet combination of FIG. 1.

Small holes 36 are formed in the lower section 28 of the helmet and preferably there are at least two pairs of holes 36. The holes of each pair are located in opposite sides of the lower section 28 and are substantially aligned with one another in the transverse direction of the helmet as can be seen in FIG. 6. In the embodiment illustrated, there are three such pairs of holes with the holes being evenly spaced and the central hole on each side being located approximately midway between the front and back of the helmet. These holes can be complete, circular holes or a small gap 38 can be formed between the bottom of each hole and a bottom edge 40 of the helmet shell. It is also possible to avoid the use of these small holes entirely and to use other attaching mechanisms as explained further below.

Figure 2:
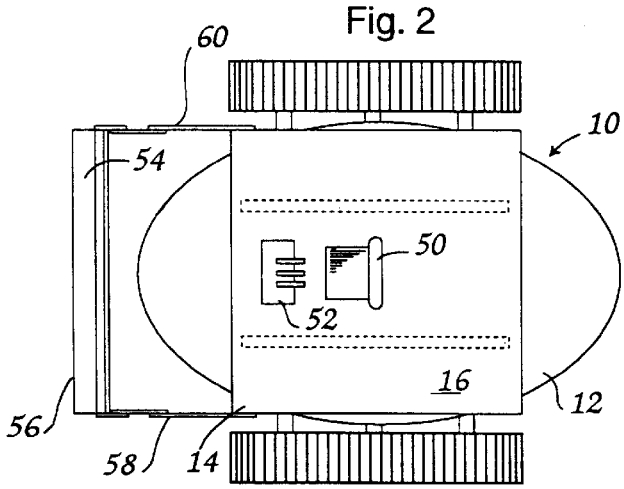
FIG. 2 is a top view of the toy vehicle and helmet combination.
Figure 3:
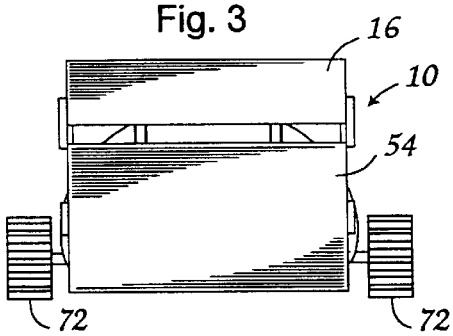
FIG. 3 is a front view of the toy vehicle and the helmet combination of FIG. 1.
Figure 4:
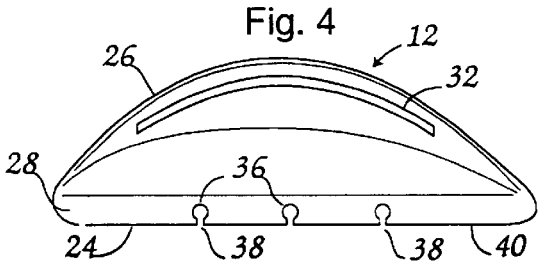
FIG. 4 is a side elevation of a protective helmet used in the toy vehicle and helmet combination of FIGS. 1 to 3.
Figure 5:
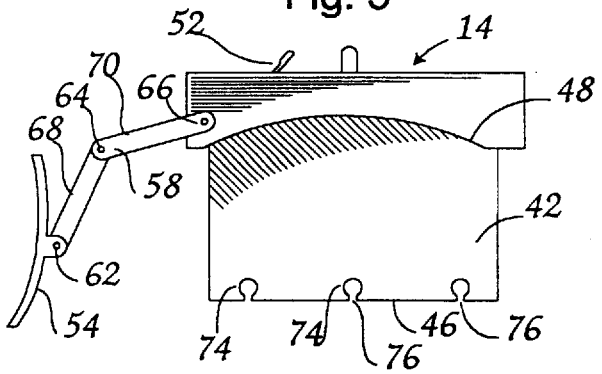
FIG. 5 is a side elevation of a toy body section used in the combination of FIG. 1.

Turning now to the preferred body section shown in FIGS. 2 and 5, the section 14 is provided with two downwardly extending connecting members 42, 44 that are rigidly joined to the upper body member 16 and are sized to extend through the two openings or slots 30, 32 in order to detachably connect the body section 14 to the shell. The illustrated connecting members are relatively rigid, flat plate members having a thickness corresponding closely to the width of each slot 30, 32. Each connecting member extends downwardly to a bottom edge 46 which in the illustrated preferred combination is located substantially at the same height level as the bottom edge 24 of the helmet. It is also possible to construct the body section with only one connecting member 42 or 44 provided it is sufficiently strong and able to properly hold the body section in place on the shell. Of course, only one connecting member is used if there is only one opening or slot 30 in the upper section of the shell. Each connecting member can be substantially rectangular except that, in a preferred version the top side 48 of each connecting member can be contoured or curved to match the contour or curve of the top of the helmet in the vicinity of the slot through which the connecting member extends. It should be noted as well that the upper body member 16 is also preferably contoured on its bottom surface to match the contour of the adjacent top surface of the helmet. In this way the toy body section fits as closely as possible to the top of the helmet when it is connected thereto.

The illustrated body section 14 for a bulldozer toy includes a simulated toy seat 50 provided on top and a toy control panel 52 located forwardly of the toy seat. Also, pivotably connected to the front of body section 14 is a toy bulldozer blade mechanism 54 which includes a transversely extending blade 56 and two support arms 58, 60. The arms extend longitudinally between the blade 56 and upper body member 16. Suitable pivot pin connectors may be provided at 62, 64 and 66. The two pins 64 can connect two arm sections 68 and 70. In the alternative, a unitary arm member can extend between each end of the blade 56 and the body member 16.

The toy wheels 18 and their respective supporting mechanisms or shafts 20 are detachably connected to the lower section of the helmet by mounting each shaft 20 in a respective pair of the holes 36. In the illustrated combination 10, the plastic material around the holes 36 is sufficiently flexible to permit each axle 20 to be snapped into its respective hole through the gap 38, which gap has a normal width slightly less than the diameter of the shaft. Using this form of connection, each toy wheel 18 can be permanently attached to its respective shaft. In the alternative, at least one toy wheel 18 on each shaft can be made detachable from the shaft and the holes 36 can be complete circular holes with no adjacent gaps 38. With this alternative, each shaft 20 is simply inserted from one side of the helmet through its respective holes 36 (after one of the wheels 18 has been removed) and then the detached wheel is reattached to the end of the shaft. After all of the wheels 18 have been attached to the helmet, one can then attach or mount two toy continuous tracks 72 made from a suitable flexible material such as rubber, synthetic rubber or flexible plastic. In order to provide adequate support for each track, the combination 10 can be provided with at least three pairs of toy wheels 18 as shown in FIG. 1. The shafts 20 of all of these pairs are parallel and arranged in a common, substantially horizontal plane. Instead of having the shafts 20 connect directly to the helmet, it is also possible to provide a separate undercarriage member to which the shafts are rotatably connected. This undercarriage member is then detachably connected to the lower section of the shell such as by means of snap-in connectors, tongue and groove connectors or other well known types of connecting mechanisms. In such a version, the undercarriage member and the shafts together form a supporting mechanism for the wheels.

In order to provide additional support for the shafts 20, further pairs of holes 74 are formed adjacent the bottom edges of the connecting members 42, 44. These holes can have the same diameter as the holes 36 in the helmet. The holes of each pair are aligned transversely with each other and they are also aligned transversely and respectively with a respective pair of holes 36 when the body section 14 is mounted on the helmet. Again, a small gap 76 may extend between each hole 74 and the bottom edge 46 in order to permit the respective shaft to be snapped into its pair of holes 74. It will be appreciated that not only does this connecting mechanism provide further support for the shafts 20, but it also helps to hold the body section 14 in place, particularly if the combination 10 is inverted during use or play.

Figure 8:
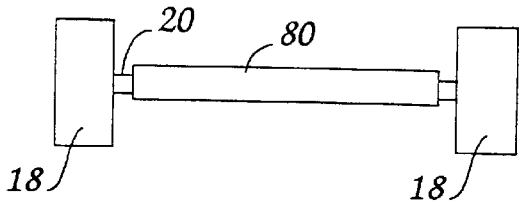
FIG. 8 is a detail front view of a pair of toy wheels connected together by a shaft, which wheels and shaft can be used in the combination of FIG. 1.

FIG. 8 of the drawings illustrates another form of shaft support that can be used for the toy wheels 18. In this version, the shaft 20 extends through an elongate sleeve 80 which is preferably plastic. The shaft 20 is free to rotate in the sleeve which provides a form of bearing for the shaft. It will be understood that with this version, the diameter of the holes 36 and the holes 74 is made equal to the diameter of the sleeve 80 which snaps into these holes. Thus, the sleeve 80 does not normally rotate in the holes 36 and 74 so that there is no wear around either the holes 36 or the holes 74 during use of the combination as a toy.

It should be noted that with the described construction of the toy/helmet combination, it is generally not possible to use the helmet 12 as a protective helmet while the various toy pieces are connected thereto. For example, connection of the shafts 20 which will extend across the open bottom of the helmet, will effectively prevent the helmet from being worn on a user's head. Even if the shafts 20 have not been connected to the helmet but the body section 14 has been mounted thereon, the provision of the downwardly extending connecting members 42, 44 will generally prevent the helmet from being worn.

Figure 9:
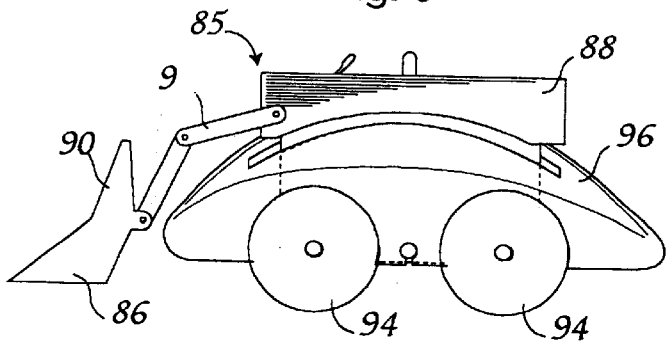
FIG. 9 is a side elevation of a second embodiment of the combination of the invention.
Figure 10:
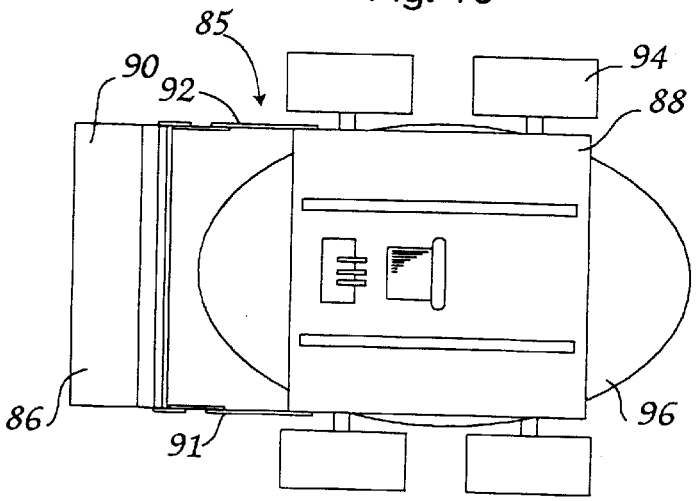
FIG. 10 is a top view of the toy vehicle and helmet combination of FIG. 9.

FIGS. 9 and 10 illustrate another toy vehicle and helmet combination 85, this combination simulating a toy front end loader when being used as a toy vehicle. As the combination 85 is similar in many respects to the combination 10 already described, only the differences between the two combinations will be described herein. Instead of a dozer blade, there is a toy front end loader bucket mechanism 86 pivotably connected to upper body member 88. The bucket mechanism includes a transversely extending loading bucket 90 and two support arms 91, 92 extending longitudinally between the bucket 90 and the upper body member. The support arms 91, 92 can be similar in their construction to the arms 58, 60 of the bulldozer version.

In the combination 85, there are only two pairs of toy wheels 94, which wheels can be somewhat larger than the wheels 18 and can be styled to simulate large rubber wheels. No toy tracks extend around the wheels 94. It will be understood that the wheels 94 are detachably connected to the protective helmet 96 in substantially the same manner as the wheels 18. If desired, the wheels 94 can comprise a combination of rubber wheels or tire portions and plastic wheel rims with the wheels being detachably from the rims in a known manner. In this way, it is possible to make the same wheel rims usable for either the bulldozer toy of FIG. 1 or the front end loader of FIG. 9. This would also make it possible to replace the wheels only if they become worn or are lost.

Figure 11:
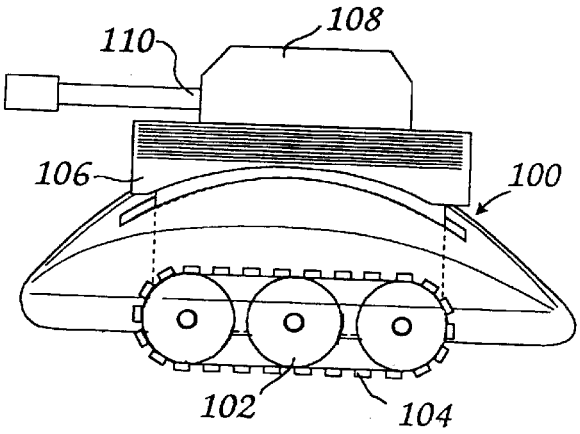
FIG. 11 is a side elevation of a third embodiment of the invention.
Figure 12:
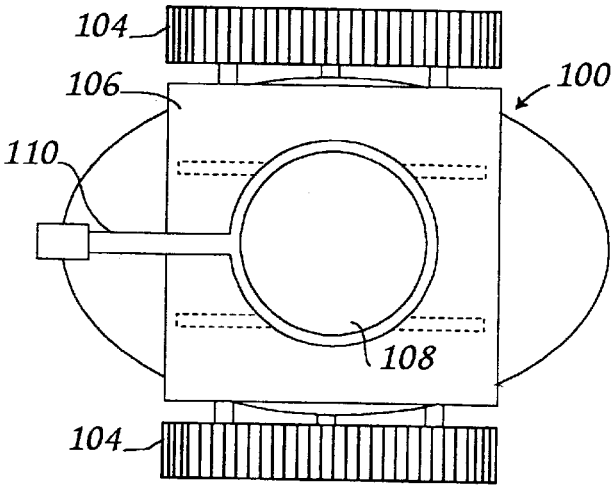
FIG. 12 is a top view of the third embodiment shown in FIG. 11.
Figure 13:
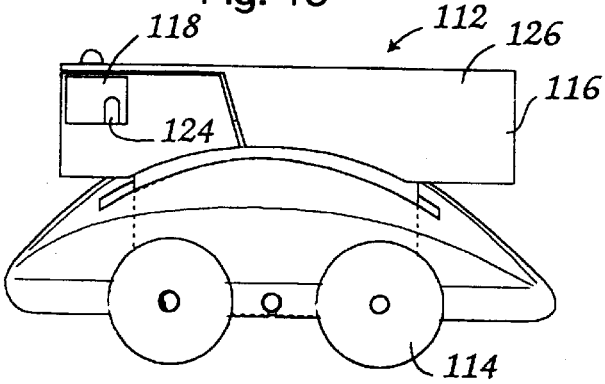
FIG. 13 is a side elevation of a fourth embodiment of the invention.
Figure 14:
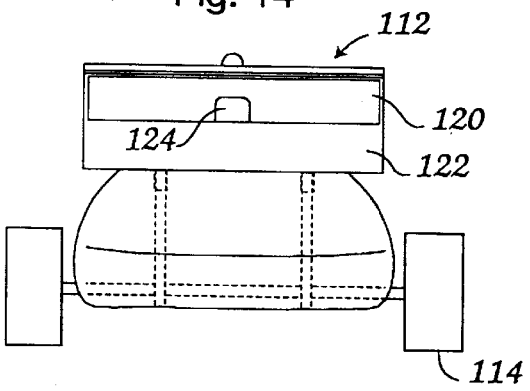
FIG. 14 is a front view of the fourth embodiment shown in FIG. 13.
Figure 15:
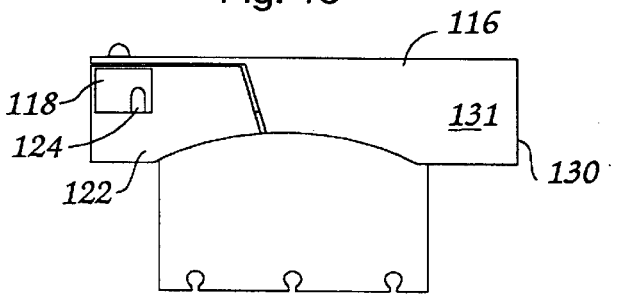
FIG. 15 is a side elevation of a toy body section used in the fourth embodiment of FIGS. 13 and 14.
Figure 16:
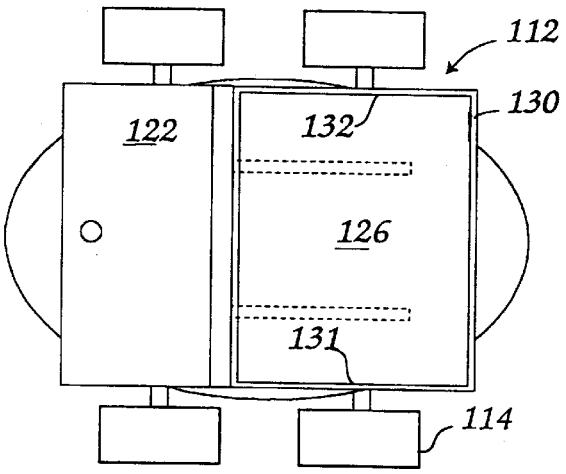
FIG. 16 is a top view of the fourth embodiment.

A further toy vehicle and helmet combination 100 is illustrated in FIGS. 11 and 12, this version representing a toy tank when being used as a toy vehicle. Except as specifically described hereinafter, the toy vehicle and helmet combination 100 is substantially the same in its construction as the combination 10 described above. As with the combination 10, the illustrated tank combination 100 is provided with three pairs of wheels 102 about which extend two toy tracks. Both the wheels and the tracks can be similar in their construction and in their mounting to the wheels 18 and the tracks 72.

Mounted on an upper body member 106 is a toy tank turret 108. A toy tank gun 110 extends from one side of the tank turret. A tank turret can either be fixed to the body member in a forwardly pointing position as shown or it can easily be made rotatable on the body member by providing a suitable pivot pin connection (not shown) at the centre and base of the turret.

Although three pairs of wheels 102 are shown, there could be as few as two pairs of toy wheels supporting the tracks 104 or there could be more than three pairs of wheels. The tracks 104 are arranged on opposite sides of the helmet as shown in FIG. 12.

Turning now to a fourth toy vehicle and helmet combination illustrated in FIGS. 13 to 16 of the drawings, this combination 112 again is similar in its construction to the combination 10 except for the differences detailed hereinafter. The combination 112 is constructed so as to represent a toy dump truck having two pairs of relatively large toy wheels 114. An upper body member 116 for use in the truck combination 112 is shown separately in FIG. 15. This upper body member has windows 118, 120 provided therein and located in a front end section 122 thereof. The windows 118, 120 are located on the sides and on the front of the body member and they simulate windows in a large truck. In order to make the toy combination more realistic, the body member 116 can be made hollow in the front end section 122 and one can view the interior of this hollow section through the windows. A toy seat 124 can be mounted inside the upper body member in the front end section.

If desired, the body member 116 can be formed with a rear end section 126 which can have an open top in order to simulate the load receiving box of a standard dump truck. The rear end section 126 can include a rear, vertically extending wall 130 and two vertical side walls 131 and 132. It is also possible to make the rear end section 126 so that it can pivot up or down relative to the rest of the body member 116 and can be used for dumping material in the rear end section. As the construction of such pivoting rear ends is well known for existing toy dump trucks, a detailed description herein is deemed unnecessary.

Figure 17:
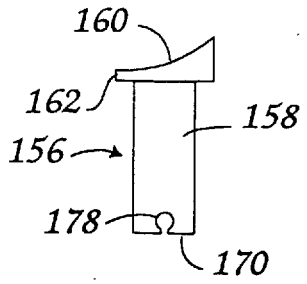
FIG. 17 is a detail side elevation of a simulated spoiler used in the fifth embodiment of the invention.
Figure 18:
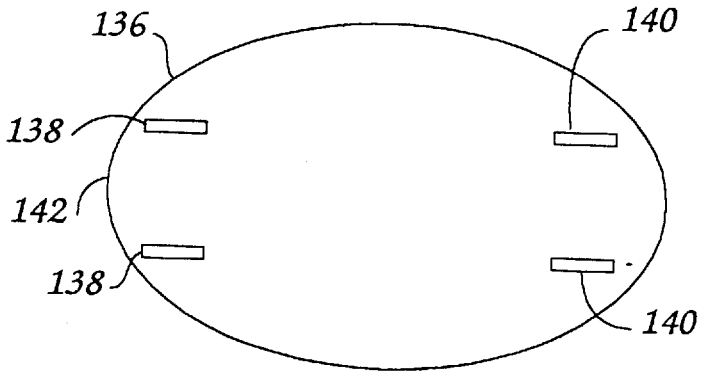
FIG. 18 is a top view of a protective helmet used in the fifth embodiment.
Figure 19:
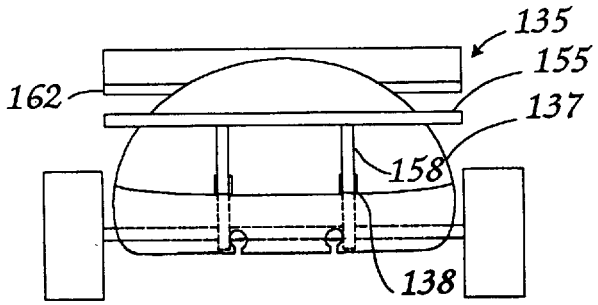
FIG. 19 is a front view of the fifth embodiment which comprises a toy car and helmet combination.
Figure 20:
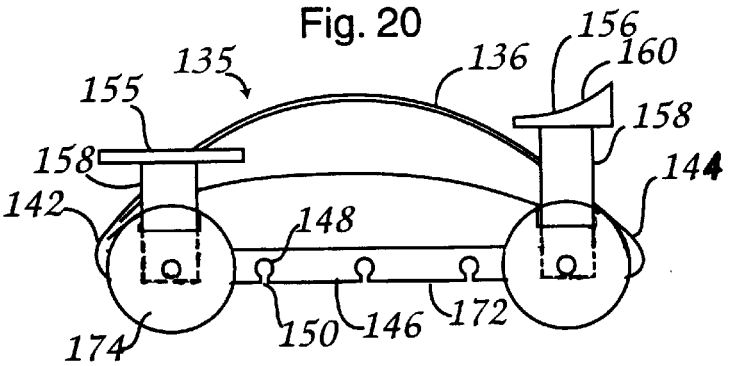
FIG. 20 is a side elevation of the toy car and helmet combination of FIG. 19.
Figure 21:
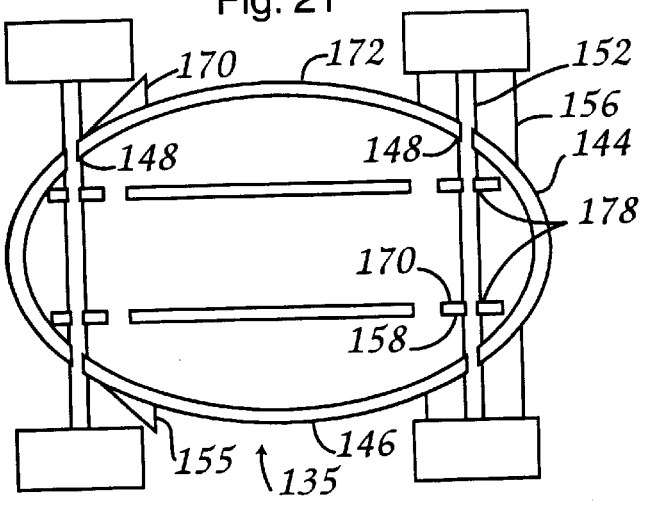
FIG. 21 is a bottom view of the combination of FIG. 19.
Figure 22:
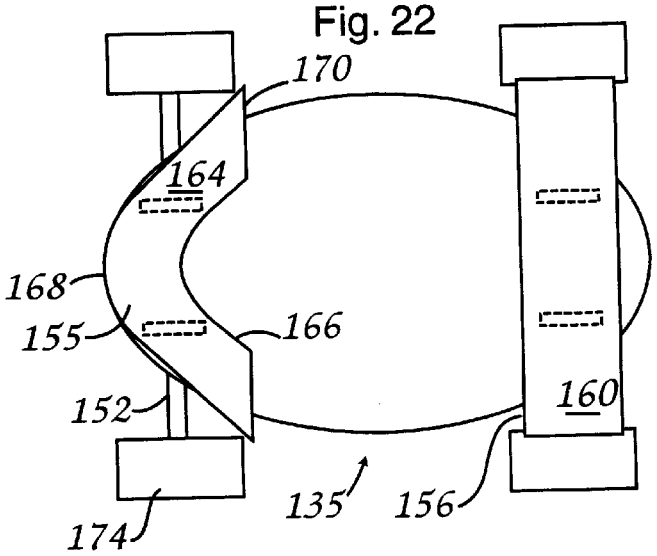
FIG. 22 is a top view of the combination of FIG. 19.

A toy car and helmet combination constructed in accordance with the invention is shown in FIGS. 19 to 22 with a separate toy section of the combination being shown in FIG. 17 and the protective helmet used in the combination being shown in FIG. 18. This combination 135 is similar in its construction to the combination 10 described above except for the differences detailed hereinafter. It includes a protective helmet 136 suitable for wearing on a user's head, this helmet including a hard shell 137 with an open bottom and at least one pair of openings 138 similar to the two openings 30, 32 of the above described embodiments. The hard shell has a lower section 146 extending around the open bottom. At least two pairs of holes 148 are formed in this lower section with the holes of each pair located in opposite sides of the lower section and substantially aligned with one another in a transverse direction of the helmet. These holes can be similar to the holes 36 in the helmet 12 of the first embodiment. If desired, a short gap 150 can extend between each hole 148 and the bottom edge of the helmet to permit wheel axles 152 to be snapped into place.

Two or more toy sections are provided for forming a toy car, for example, a toy race car, with the helmet 136. In the illustrated combination 135, there is a front toy section 155 and a rear toy section 156, the latter being shown separately in FIG. 17. Each of these toy sections is adapted for mounting on top of the hard shell and has at least one and preferably two downwardly extending connecting members 158 that are sized and arranged to extend through the pair of openings 138, in order to detachably connect the toy section to the shell, and preferably to a wheel assembly as shown.

In the illustrated combination 135, the rear toy section 156 is a simulated spoiler having an upper surface 160 that curves upwardly and rearwardly from a transversely extending forward edge 162 thereof. The simulated spoiler is mountable near the rear end 144 of the helmet.

The front toy section 155 of the illustrated combination forms an air wing or a front section of a toy race car. It is formed with a substantially horizontal upper surface 164 with a curved rear edge 166 conforming to an adjacent convex surface of a frontal portion of the helmet shell. The illustrated section 155 also has a curved front edge 168 that may extend back to a point 170 on each side of the helmet.

In the preferred toy combination 135, the pair of openings 138 comprises narrow, spaced apart parallel slots extending in a front to back direction of the helmet. The connecting members 158 are relatively rigid, plate members having a thickness corresponding closely to the width of each of these slots. It is also possible for the helmet to be provided with two (or more) pairs of openings or slots to attach the toy sections to the helmet. For example, there could be a pair of slots located near the front end of the helmet for the toy section 155 and another pair of slots near the rear end of the helmet for the toy section 156.

It will be appreciated that other forms of connecting members for the toy sections could also be used in the invention. For example, the or each flat plate member 158 could be replaced by a suitable, round post or peg that extends through a suitable hole formed in the helmet shell. Regardless of the form of connector used, the size and shape of the hole or slot through which the connector extends must be such that it does not significantly affect the structural integrity of the protective helmet so that the helmet will still pass all safety requirements for helmets of that type.

Preferably and as illustrated, each plate member or connector 158 extends downwardly to a bottom edge 170. This bottom edge is located substantially at the same height level as the bottom edge 172 of the shell when the toy section or sections together with toy wheels 174 are mounted on the shell. As in the previous embodiments, further pairs of holes 178 are formed adjacent the bottom edges of the plate members. In the illustrated toy sections 155, 156 there is one such pair provided in each section. These further pairs of holes are aligned transversely and respectively with at least some of the pairs of holes 148 formed in the lower section of the shell and are adapted to provide further means for detachably connecting the shafts 152 to the helmet. The combination 135 includes two pairs of toy wheels 174 and supporting mechanisms or shafts 152 for rotatably mounting these wheels in the holes 148 formed in a lower section.

Although not specifically shown in the drawings comprising FIGS. 18 to 22, the hard shell of the helmet can be patterned to make it particularly suitable for constructing a toy car or toy race car. For example, it can be coloured and patterned to depict car windows, car doors, etc.

Figure 24:
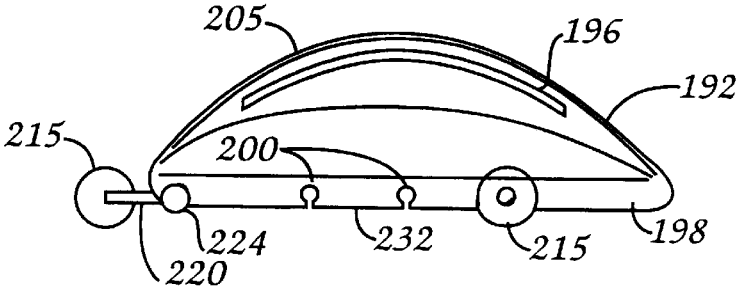
FIG. 24 is a side elevation of a protective helmet fitted with toy wheels for use in a toy flying craft and helmet combination of the invention.
Figure 25:
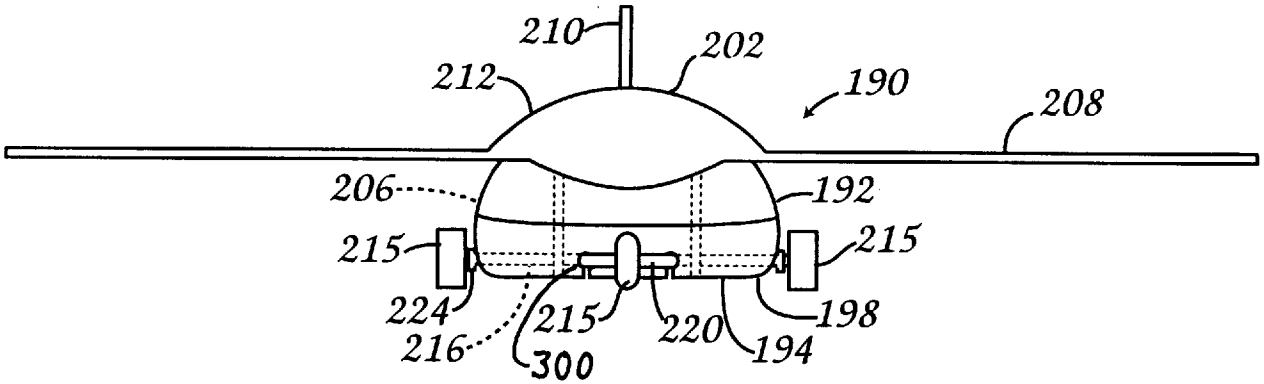
FIG. 25 is a front view of a first form of toy flying craft and helmet combination constructed in accordance with the invention.
Figure 27:
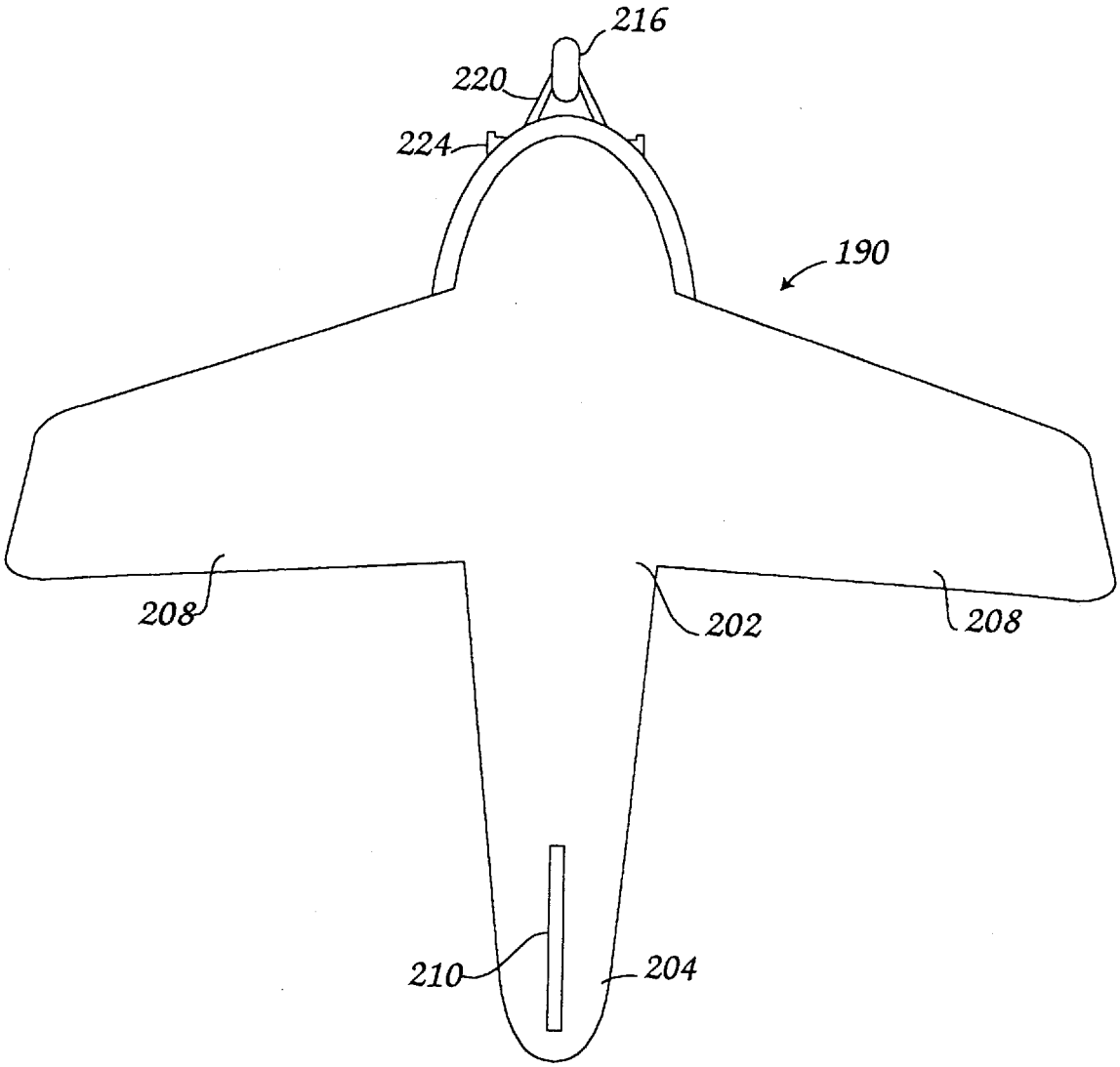
FIG. 27 is a top view of the toy flying craft and helmet combination of FIG. 25.
Figure 28:
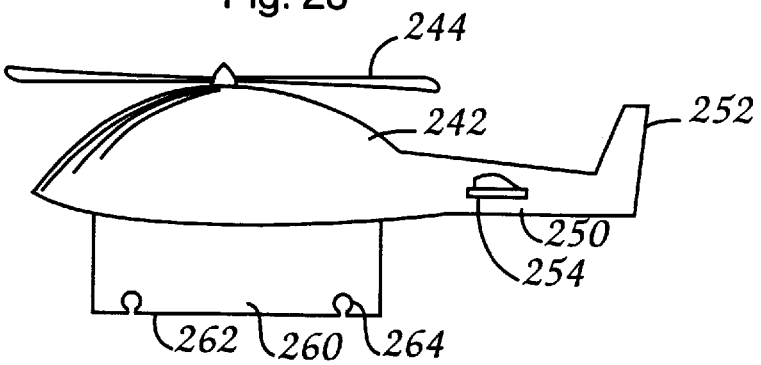
FIG. 28 is a side elevation of a second form of toy flying craft body section.

FIGS. 25 and 27 depict a first version of a toy flying craft and helmet combination constructed in accordance with the invention. This combination 190 includes a modified protective helmet 192 suitable for wearing on a user's head when not being used as a toy. The helmet includes a hard shell with an open bottom at 194 and an upper section with at least one opening and preferably at least two openings 196 formed therein. Only one of these openings is shown in FIG. 24 but the other opening is the same in shape and size and extends parallel to the illustrated opening. A lower section 198 of the helmet extends around the open bottom. This lower section has means for detachably attaching toy wheels such as small holes 200 formed therein including at least one pair of holes. The holes of the or each pair are located in opposite sides of the lower section 198 and are substantially aligned with one another in a transverse direction of the helmet. It should be understood that in a preferred version of this combination 190, the helmet 192 can be the same as the above described helmet 12. In this way the same helmet can be used to construct several different toys if one has the necessary toy body sections.

Figure 23:
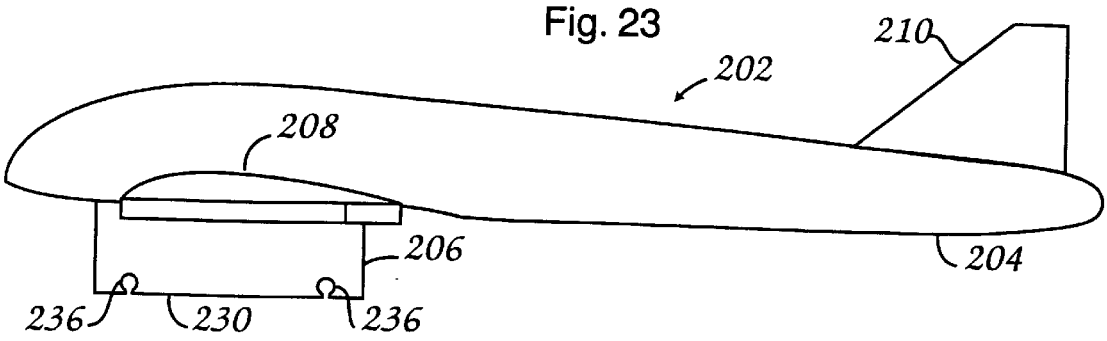
FIG. 23 is a side elevation of a toy flying craft body section used in a further embodiment of the invention.

FIG. 23 illustrates a toy flying craft body section 202 with a rearwardly extending tail section 204. This body section is mounted on top of the upper section 205 of the shell. It has at least one and preferably at least two connecting members 206 that are sized and arranged to extend through the at least one and preferably two openings 196 in order to detachably connect the body section 202 to the helmet shell and preferably to the wheel axles as well. In the version of FIGS. 25 and 27, the body section has the shape of an airplane and two elongate, substantially horizontal wings 208 extend from opposite sides of the body section. The wings 208 can be made detachable from the central portion 212 if desired. Standard pin and hole connectors can be used for this purpose (not shown). A rudder 210 can also be formed on the tail section 204 if desired. It will further be understood that the central portion 212 of the body section 202 which is located between the wings has an undersurface shaped to closely receive and conform to the upper section of the helmet.

As in the previously described embodiments, preferably the two or more openings 196 in the helmet shell are narrow, elongate, parallel slots extending in a front to back direction of the helmet. With such slots, the connecting members 206 are flat plate members having a thickness corresponding closely to the width of each slot.

Figure 7:
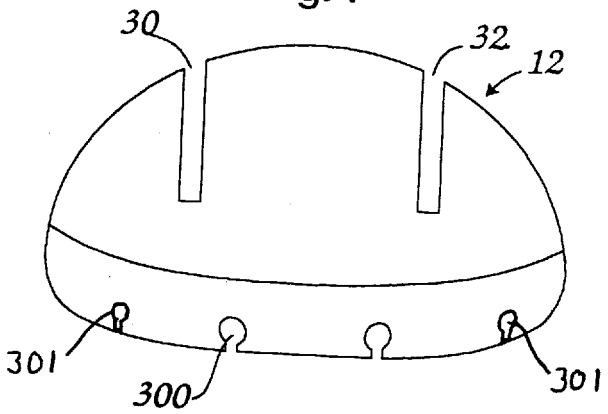
FIG. 7 is front view of the protective helmet of FIG. 4.
Figure 26:
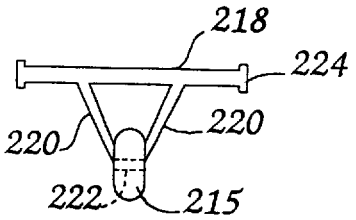
FIG. 26 is a top view of a single front wheel and a shaft connector for same used in the combination of FIG. 25.

The flying craft combination 190 is also equipped with toy wheels 215 and means for mounting these wheels by means of two or more of the holes 200, 301 formed in the lower section of the helmet. In the combination 190, there are three toy wheels 215 with the rear wheels 215 being connected by means of a single elongate shaft or axle 216. The mounting of the rear wheels 215 can be the same as the mounting arrangement for the wheels 18 in the first embodiment described above. The mounting mechanism for the front wheel 215 is shown separately in FIG. 26 and it can include transversely extending shaft member 218 and two wheel connecting struts 220 that extend forwardly from the shaft member 218 to the wheel and on which the wheel 215 is rotatably mounted. The struts 220 can be connected together at their front ends by means of a short connecting shaft indicated at 222. Opposite ends of the shaft member 218 can be provided with protuberances 224 which act as locating members to properly position the front wheel assembly when it is connected to the helmet. Forward holes or openings 301 at the front of the helmet receive the shaft member 218 (see the helmet of FIG. 7). Suitable holes 300 can be provided at the front end of the helmet to accommodate the horizontal struts 220.

As in the above described embodiments, the preferred connecting members are plate members that extend downwardly to a bottom edge 230 which, when the body section is mounted on the helmet shell, is located substantially at the same height level as a bottom edge 232 of the shell. In the illustrated embodiment, there are two pairs of holes 236 formed adjacent the bottom edges of the two plate members and at least one of these pairs is aligned with at least one of the pairs of holes in the lower section of the shell. The aligned pairs of holes 236 in the plate members are adapted to provide further means for mounting the rear toy wheels 215. In the illustrated embodiment, the plate members do not have holes aligned with the holes 301 in the helmet, which holes accommodate the shaft member 218.

Figure 29:
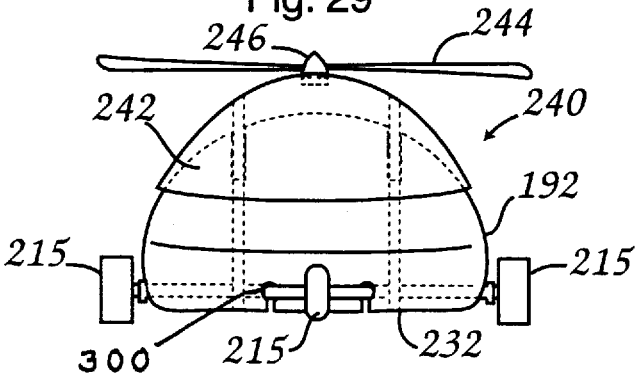
FIG. 29 is a front view of a second embodiment of a toy flying craft and helmet combination constructed in accordance with the invention.
Figure 30:
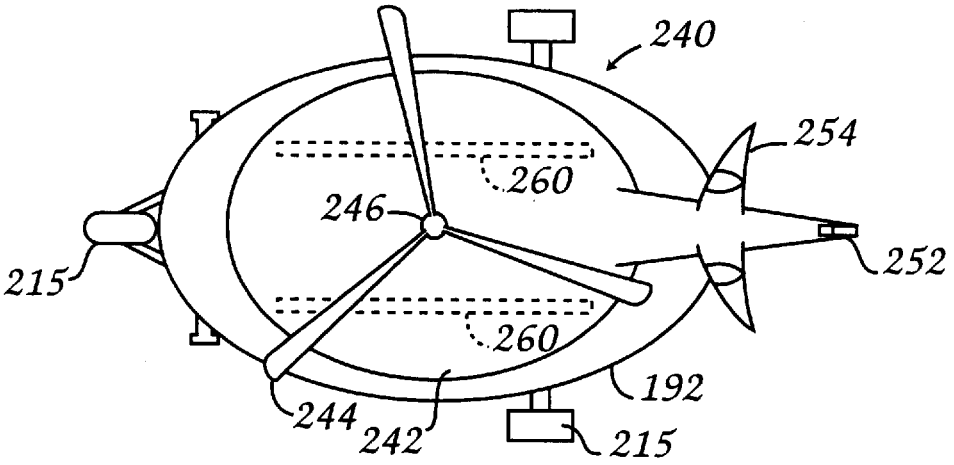
FIG. 30 is a top view of the combination of FIG. 29.
Figure 31:
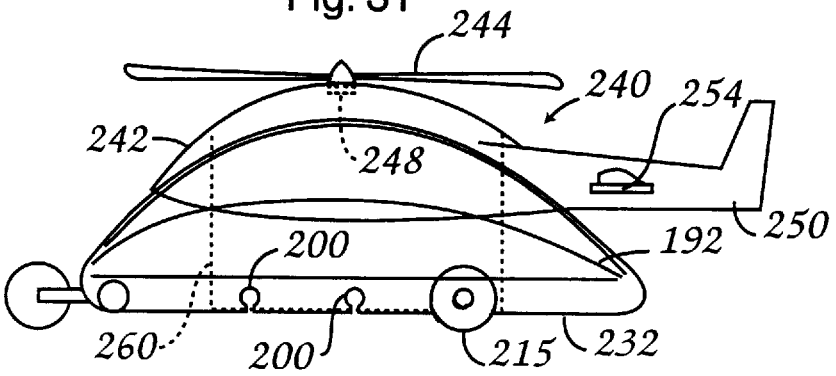
FIG. 31 is a side elevation of the combination of FIG. 29.

Another embodiment of a toy flying craft and helmet combination is illustrated in FIGS. 29 to 31. This combination 240 includes a protective helmet 192 similar to or the same as that shown in FIG. 24 separately. This helmet also has small holes 200 formed in a lower section of the helmet with the holes of the or each pair located in opposite sides of the lower section and substantially aligned with one another in a transverse direction. The combination 240 includes a toy flying craft body section 242 shaped to simulate a helicopter and having a bottom surface shaped to fit snugly on top of the helmet. Rotatably mounted on top of the body section 242 are toy helicopter blades 244, which blades have a substantially vertical axis of rotation located in the transverse center of the body section. The blades are mounted on a central hub section 246 which can include a short, downwardly extending pivot pin that extends through the top of the body section 242. The pin is held in place by means of an end flange indicated at 248. If desired, the blades 244 can be made so that they are detachable from the body section. This can be done in any suitable known manner such as a snap pin and socket connection (not shown).

If desired, the body section 242 can also be provided with a rearwardly extending tail section 250 including an upwardly projecting rudder 252. An optional feature on the tail section could include short, horizontally projecting wing members 254. If desired, a small propeller member (not shown) could also be provided on the rudder 252 to further simulate an actual helicopter.

As in the above described embodiments, the body section 242 is also provided with at least one and preferably two connecting members in the form of flat plate members 260 which extend through elongate slots formed in the top section of the helmet. Each plate member 260 extends downwardly to a bottom edge 262 which, when the body section 242 is mounted on the helmet, is located at the same height level approximately as the bottom edge 232 of the shell. In the illustrated plate member there are two pairs of holes 264 formed adjacent the bottom edges of the plate members. One of these pairs of holes is aligned with a pair of holes 200 formed in the bottom section of the helmet shell. This pair of holes 264 in the plate members is adapted to provide further means for mounting the rear toy wheels 215. The front wheel 215 can be mounted to the front end of the helmet in the same manner as in the combination shown in FIGS. 25 and 27.

It will be appreciated by those skilled in the toy art that there are various possible means and mechanisms for attaching the toy wheels to the helmet instead of the illustrated metal shafts or axles. For example, one could employ a short stub shaft for each wheel to rotatably mount the wheel in a hole in the lower section of the helmet. Also, one could employ Velcro (trademark) or hook and loop type fastener strips to either attach individual wheels to the helmet or a wheel supporting undercarriage. Magnets or clips are other forms of detachable connectors that can be used for this purpose.

It will also be understood that it is possible to alter the shape of a standard protective helmet somewhat to make it more suitable for making a toy combination without making it less effective as a protective helmet. For example, the helmet 136 shown in FIGS. 18 to 22 could be altered somewhat in its shape to make it closer to the body shape of an Indy racing car.

It is also possible to add a suitable motor such as a small electric motor to the toy and helmet combination in order that the combination can move along on the ground on its own power. Such a motor is well known in the toy car art and therefore a detailed description herein is deemed unnecessary. The motor can be mounted on a suitable undercarriage attached to the lower section of the helmet and used to support the wheels and axles as well.

It will be appreciated by those skilled in the construction of helmets and toys that various modifications and changes can be made to the described and illustrated embodiments without departing from the spirit and scope of this invention. In fact, a wide variety of toy and helmet combinations can be made within the scope of the present invention. All such combinations as fall within the scope of the appended claims are intended to be part of this invention.

I claim:

1. A toy vehicle and helmet combination comprising:

a protective helmet suitable for wearing on a user's head, said helmet including a rigid shell with an open bottom, an upper section with at least one opening formed therein, and a lower section extending around said open bottom;

a toy body section with an upper body member adapted for mounting on top of said upper section of the shell and for combining with the shell to form a toy vehicle and at least one connecting member joined to said upper body member and sized to extend through said at least one opening in order to detachably connect said body section to said shell; and toy wheels and at least one supporting mechanism for mounting said wheels, wherein said lower section of the helmet includes means for detachably attaching said at least one supporting mechanism to said shell.

2. A toy vehicle and helmet combination according to claim 1 wherein said helmet has at least two openings formed therein and said toy body section has at least two connecting members which are sized to extend through said at least two openings to detachably connect said body section to said shell.

3. A toy vehicle and helmet combination according to claim 2 including at least two pairs of said toy wheels, wherein said at least one supporting mechanism includes shafts for rotatably mounting said pairs of wheels and said attaching means comprises at least two pairs of holes formed in said lower section with the holes of each pair being located in opposite sides of said lower section and substantially aligned with one another in a transverse direction of the helmet, each of said shafts being connectible to said lower section by mounting the shaft in a respective one of or a respective pair of said holes.

4. A toy vehicle and helmet combination according to claim 3 wherein said at least two openings in the shell are narrow, elongate, parallel slots extending in a front to back direction of the helmet and said connecting members are relatively rigid, downwardly extending plate members having a thickness corresponding closely to the width of each slot.

5. A toy vehicle and helmet combination according to claim 4 wherein when said body section is mounted on said shell, each plate member extends downwardly to a bottom edge of the plate member located substantially at the same height level as a bottom edge of said shell, and wherein further pairs of holes are formed adjacent the bottom edges of the plate members, said further pairs of holes being aligned transversely and respectively with at least some of said pairs of holes in said lower section of the shell and being adapted to provide further means for detachably connecting the shafts to said helmet.

6. A toy vehicle and helmet combination according to claim 1 including a toy bulldozer blade mechanism pivotably connected to said upper body member, said blade mechanism including a transversely extending blade and two support arms extending longitudinally between said blade and said upper body member.

7. A toy vehicle and helmet combination according to claim 1 including a toy front end loader bucket mechanism pivotably connected to said upper body member, said bucket mechanism including a transversely extending loading bucket and two support arms extending longitudinally between said bucket and said upper body member.

8. A toy vehicle and helmet combination according to claim 1 wherein said upper body member simulates part of a toy truck and has windows provided therein and located in a front end section thereof.

9. A toy vehicle and helmet combination according to claim 3 wherein said combination has at least three pairs of said toy wheels mounted on said shafts which are parallel and arranged in a common, substantially horizontal plane, and including two toy continuous tracks adapted for mounting on said wheels on opposite sides of said helmet.

10. A toy vehicle and helmet combination according to claim 3 wherein said upper body member includes a toy tank turret and a toy tank gun extending from one side of said tank turret and two continuous tracks are provided for mounting on said at least two pairs of toy wheels, said tracks in use being arranged on opposite sides of the helmet.

11. A toy car and helmet combination comprising:

a protective helmet suitable for wearing on a user's head, said helmet including a rigid shell with an open bottom and at least one attachment opening, said shell having a lower section extending around said open bottom;

two toy sections for forming a toy car with said helmet, each of said toy sections being adapted for mounting on top of said rigid shell and having at least one connecting member that is sized and arranged to extend through said at least one attachment opening in order to detachably connect the toy section to said shell; and toy wheels and at least one supporting mechanism for mounting same, wherein said lower section of the helmet includes means for detachably attaching said at least one supporting mechanism to said shell.

12. A toy car and helmet combination according to claim 11 wherein said shell has at least one pair of attachment openings and each toy section has connecting members and each toy section has connecting members sized and arranged to extend through the pair or one of the pairs of attachment openings in order to connect the toy section to said shell.

13. A toy car and helmet combination according to claim 12 wherein said attaching means comprises at least two pairs of holes formed in said lower section with the holes of each pair located in opposite sides of the lower section and substantially aligned with one another in a transverse direction of the helmet and said at least one supporting mechanism comprises shafts for rotatably mounting said toy wheels in the holes formed in said lower section.

14. A toy car and helmet combination according to claim 13 wherein one of said toy sections is a simulated spoiler having an upper surface that curves upwardly and rearwardly from a transversely extending forward edge thereof, said simulated spoiler being mountable near a rear end of the helmet.

15. A toy car and helmet combination according to claim 13 wherein the or each pair of attachment openings in said shell comprises narrow, spaced apart, parallel slots extending in a front to back direction of the helmet and said connecting members are relatively rigid, downwardly extending plate members having a thickness corresponding closely to the width of each slot.

16. A toy car and helmet combination according to claim 15 wherein, when said toy sections and said toy wheels are mounted on said shell, each plate member extends downwardly to a bottom edge thereof located substantially at the same height level as a bottom edge of the shell, and wherein further pairs of holes are formed adjacent the bottom edges of the plate members, said further pairs of holes being aligned transversely and respectively with at least some of said pairs of holes formed in said lower section of the shell and being adapted to provide further means for detachably connecting said shafts to said helmet.

17. A toy flying craft and helmet combination comprising:

a protective helmet suitable for wearing on a user's head, said helmet including a rigid shell with an open bottom, an upper section with at least one opening formed therein, and a lower section extending around said open bottom;

a toy flying craft body section with a rearwardly extending tail section, said body section being mountable on top of said upper section of the shell in order to combine with the shell to form a toy flying craft and having at least one connecting member that is sized and arranged to extend through said at least one opening in order to detachably connect said body section to said shell; and toy wheels and at least one supporting mechanism for mounting said toy wheels, wherein said lower section of the helmet includes means for detachably attaching said at least one support mechanism to said shell.

18. A toy flying craft and helmet combination according to claim 17 wherein said upper section has at least two openings formed therein and said body section has connecting members sized and arranged to extend through said at least two openings to connect said body section to the shell and wherein said attaching means comprises small holes formed in said lower section including at least one pair of holes with the holes of each pair located in opposite sides of said lower section and substantially aligned with one another in a transverse direction of the helmet.

19. A toy flying craft and helmet combination according to claim 18 wherein said at least one supporting mechanism comprises shafts for rotatably mounting said toy wheels in at least some of said small holes.

20. A toy flying craft and helmet combination according to claim 18 wherein said body section has a shape of an airplane and two elongate, substantially horizontal wings extend from opposite sides of said body section.

21. A toy flying craft and helmet combination according to claim 18 wherein said body section is shaped to simulate a helicopter and toy helicopter blades are rotatably mounted on top of said body section, said blades having a substantially vertical axis of rotation located in the transverse centre of the body section.

22. A toy flying craft and helmet combination according to claim 18 wherein said at least two openings in the shell are narrow, elongate, parallel slots extending in a front to back direction of the helmet and said connecting members are flat plate members having a thickness corresponding closely to the width of each slot.

23. A toy flying craft and helmet combination according to claim 22 wherein, when said body section is mounted on said shell, each plate member extends downwardly to a bottom edge of the plate member located substantially at the same height level as a bottom edge of said shell, and wherein at least one pair of holes is formed adjacent the bottom edges of the plate members and is aligned with at least one pair of holes in said lower section of the shell, said at least one pair of holes in the plate members being adapted to provide further means for mounting said toy wheels.

* * * * *